US006167925B1

(12) United States Patent
D'Andrade et al.

(10) Patent No.: US 6,167,925 B1
(45) Date of Patent: Jan. 2, 2001

(54) BLADDER WATER GUN WITH PUMP AND QUICK CHARGE SYSTEM

(76) Inventors: Bruce M. D'Andrade, deceased, late of Whitehouse Station, NJ (US) 08889; by Mary Ann D'Andrade, executrix, 3 Ten Eyck Rd., Whitehouse Station, NJ (US) 08889

( * ) Notice: Under 35 U.S.C. 154(b), the term of this patent shall be extended for 0 days.

(21) Appl. No.: 09/227,066

(22) Filed: Jan. 5, 1999

Related U.S. Application Data

(60) Provisional application No. 60/088,953, filed on Jun. 11, 1998.

(51) Int. Cl.[7] ..... B65B 39/00

(52) U.S. Cl. ..... 141/348; 141/349; 222/79; 222/386.5

(58) Field of Search ..... 222/79, 212, 207, 222/209, 386.5, 1; 141/348, 349

(56) References Cited

U.S. PATENT DOCUMENTS 5,850,941 12/1998 Johnson et al. .
5,875,927 * 3/1999 D'Andrade ..... 222/79
5,915,771 6/1999 Amron .

* cited by examiner

*Primary Examiner*—Kevin Shaver
*Assistant Examiner*—Thach H. Bui
(74) *Attorney, Agent, or Firm*—Akin, Gump, Strauss, Hauer & Field, L.L.P.

(57) ABSTRACT

A toy gun having a housing is provided. A trigger is attached to the housing and a liquid storage tank is provided on the housing along with a pressure chamber having an opening which receives an expandable bladder. Also attached to the housing is a pump which is in fluid communication with the liquid storage tank. The pump is adapted to transfer liquid from the liquid storage tank to the expandable bladder in order to charge the expandable bladder with pressurized liquid as the pump is actuated by a user. In addition, a release valve is included for regulating a discharge of liquid contained in the expandable bladder. A path of fluid communication provides fluid communication between the expandable bladder, the pump, the storage tank and a nozzle assembly. The nozzle assembly is adapted for insertion into a quick charge device. The quick charge device is adapted to force liquid from the quick charge device and through the nozzle assembly in order to recharge the expandable bladder. Once the bladder is recharged, movement of the trigger displaces the release valve to regulate the movement of pressurized liquid through a part of the path of fluid communication for discharging a stream of liquid from the nozzle assembly.

26 Claims, 11 Drawing Sheets

BLADDER WATER GUN WITH PUMP AND QUICK CHARGE SYSTEM

CROSS REFERENCE TO RELATED APPLICATIONS

This application claims the benefit of U.S. Provisional Application No. 60/088,953, filed Jun. 11, 1998.

BACKGROUND OF THE INVENTION

The present invention is directed to toy water guns having expandable bladders and more particularly, to a toy water gun having an expandable bladder which can be charged using a pump located on the water gun or an auxiliary hose connection for quick charging the water gun.

Bladder water guns having an on-board pump are known, such as disclosed in applicant's prior U.S. patent application Ser. No. 08/672,941, filed on Jun. 28, 1996, now allowed, which is incorporated herein by reference as if fully set forth.

Such water guns have proven to be extremely popular and successful in the market. However, it would be desirable to provide a water gun which can be rapidly charged without the need for pumping if an external pressurized water source, such as public water, is available. This would provide for enhanced enjoyment and ease of use, especially for younger users who may have more difficulty using the manual pump. Additionally, it would desirable to maintain the ability to pressurize the water gun using a manual pump located on the gun when an external source of pressurized water is not available. Other improvements which should reduce the cost of manufacturing are also provided.

SUMMARY OF THE INVENTION

Briefly stated, the present invention provides for a toy gun having a housing. A trigger is attached to the housing. A liquid storage tank is provided on the housing along with a pressure chamber having an opening which receives an expandable bladder. Also attached to the housing is a pump which is in fluid communication with the liquid storage tank. The pump is adapted to transfer liquid from the liquid storage tank to the expandable bladder in order to charge the expandable bladder with pressurized liquid as the pump is actuated by a user. In addition, a release valve is included for regulating a discharge of liquid contained in the expandable bladder. A path of fluid communication provides fluid communication between the expandable bladder, the pump, the storage tank and a nozzle assembly. The nozzle assembly is adapted for insertion into a quick charge device. The quick charge device is adapted to force liquid from the quick charge device and through the nozzle assembly in order to recharge the expandable bladder. Once the bladder is recharged, movement of the trigger displaces the release valve to regulate the movement of pressurized liquid through a part of the path of fluid communication for discharging a stream of liquid from the nozzle assembly.

In another aspect, the present invention provides a toy gun system adapted to discharge a stream of liquid under pressure. The system includes a toy gun and a recharging adapter. The toy gun has a housing, a nozzle assembly at one end of the housing, a pump connected to the housing, a liquid storage tank attached to the housing, and a pressurizable chamber having an opening located on the housing. An expandable bladder is located in the pressure chamber, and a path of fluid communication is provided between the bladder, the pump, and the nozzle assembly. The recharging adapter includes a receptacle adapted to receive he nozzle assembly. A valve body is slidably disposed in the receptacle, and a liquid channel is located in the valve body. An attachment is provided on the recharging adapter for connection to an external source of pressurized liquid. The nozzle assembly of the toy gun is adapted to be inserted in the receptacle of the recharging adapter to displace the valve body to an open position allowing liquid from an external source of pressurized liquid to travel through the valve body, the nozzle assembly and the path of fluid communication and into the expandable bladder.

In another aspect, the present invention provides a method of operating a toy gun system. The method includes:

(a) providing a toy gun having a housing, a liquid storage tank attached to said housing, a pressure chamber having an opening located on said housing, an expandable bladder located in said pressure chamber, a pump, and a path of fluid communication between a nozzle assembly, said expandable bladder and said pump;

(b) charging said expandable bladder by one of:

(i) pumping liquid via said pump from said storage tank through said path of fluid communication into said expandable bladder; and (ii) inserting said nozzle assembly in a receptacle of a recharging adapter and moving a normally closed valve body to an open position allowing pressurized liquid to flow from said recharging adapter through said nozzle assembly and said path of fluid communication into said expandable bladder;

(c) discharging said bladder by displacing said release valve via a trigger connected to said release valve to eject a stream of liquid from said toy gun; and (d) recharging said toy gun in accordance with step (b).

BRIEF DESCRIPTION OF THE SEVERAL VIEWS OF THE DRAWINGS

The foregoing summary, as well as the following detailed description of the preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
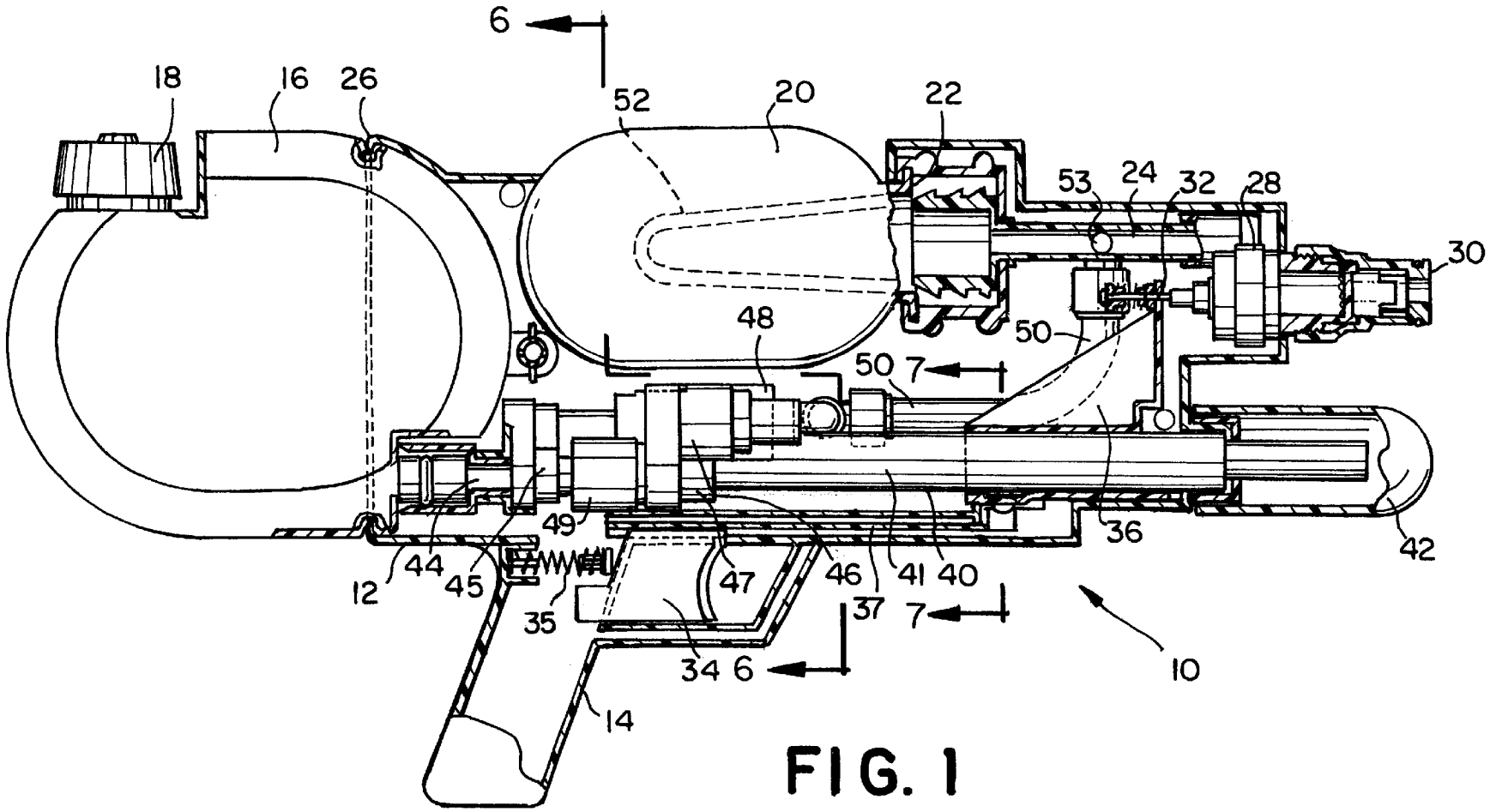
FIG. 1 is a left side elevational view, partially broken away, showing a bladder water gun in accordance with a first embodiment of the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the toy water gun in accordance with the present invention, and designated parts thereof. The terminology includes the words noted above as well as derivatives thereof and words of similar import.

Referring to the drawings, wherein like numerals indicate like elements throughout, there is shown in FIGS. 1–8 a water gun 10 in accordance with the present invention. While the preferred embodiments of the invention are preferably water guns, it will be recognized by those skilled in the art that the toy gun 10 can be used with any liquid. For the sake of convenience, the preferred embodiments will therefore be described as water guns, although this is not intended to limit the present invention from use with other liquids. As shown in detail in FIGS. 1—4, the water gun 10 includes a housing 12 having a handle 14 which can be grasped by a user. Preferably, the housing 12 and handle 14 are molded from a polymeric material in one or more pieces, and are assembled together to form the housing 12. However, it will be recognized by those skilled in the art from the present disclosure that the housing 12 may be made using any desired method, such as machining, and from any suitable material, as desired.

A storage tank 16 having a cap 18 is attached to the housing 12. Preferably, the storage tank 16 is molded from a polymeric material and includes a keyed or form locking connection 26 for assembly of the storage tank 16 with the housing 12 as shown in detail in FIGS. 1 and 2. The cap 18 is engaged to the tank 16 via threads. Preferably, the cap 18 includes a vent opening 19, as shown in FIG. 2, and a two-way rubber vent is located within the cap 18 to allow air to enter and exit the tank 18.

Figure 9:
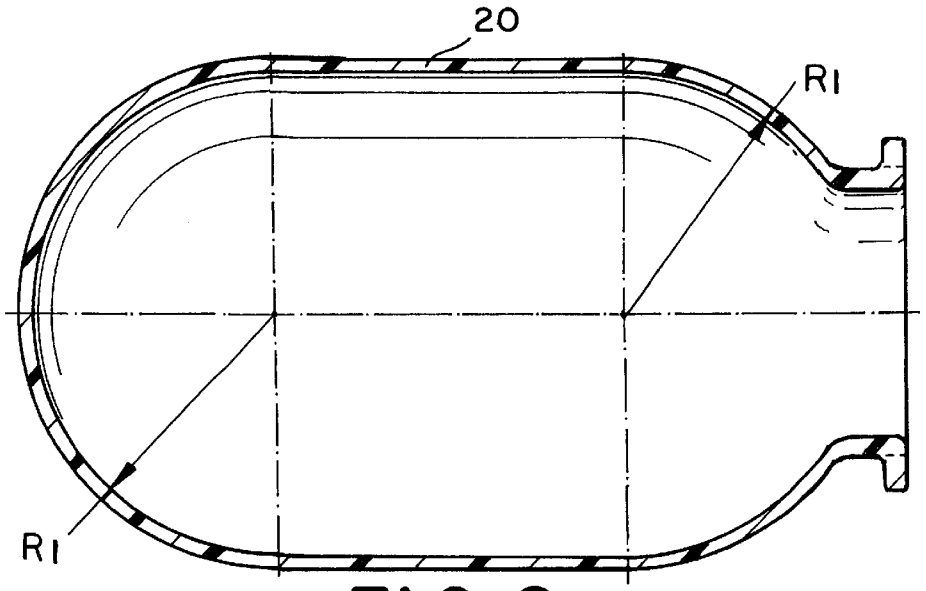
FIG. 9 is a cross-sectional view of the bladder pressure chamber used in the water gun in accordance with the first embodiment of the present invention.

A pressure chamber 20, which is shown in detail in FIG. 9, is also attached to the housing 12. The pressure chamber 20 is preferably molded from a polymeric material and includes a smooth interior surface having spherical radii R1 at both ends with a cylindrical wall located therebetween. The pressure chamber 20 has an opening 21 through which an expandable bladder 52 is inserted, as explained in more detail below. The pressure chamber 20 is designed to have sufficient strength to hold the expandable bladder 52 and prevent over pressurization of the expandable bladder 52.

Figure 2:
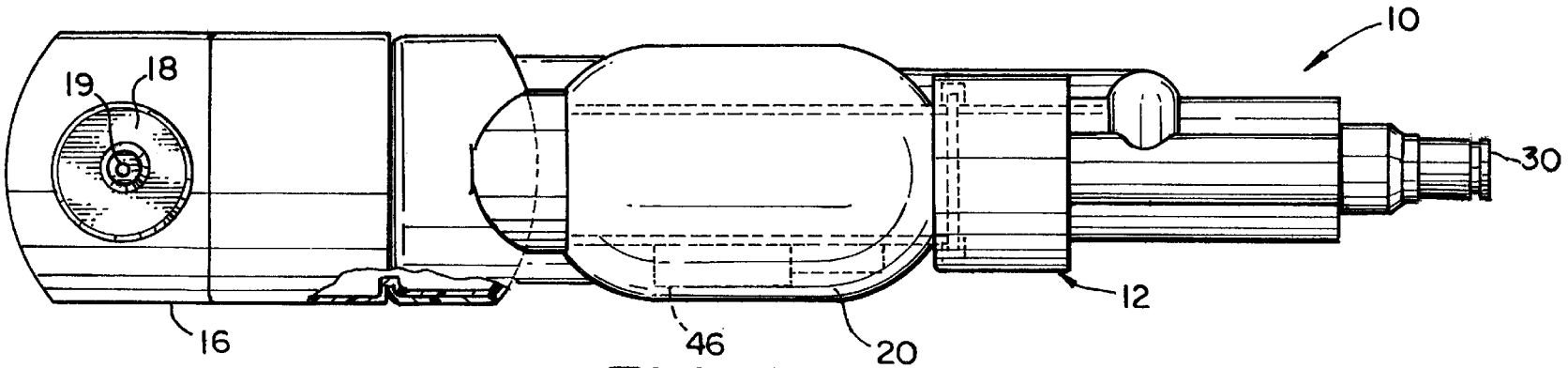
FIG. 2 is a top view of the water gun shown in FIG. 1.
Figure 4:
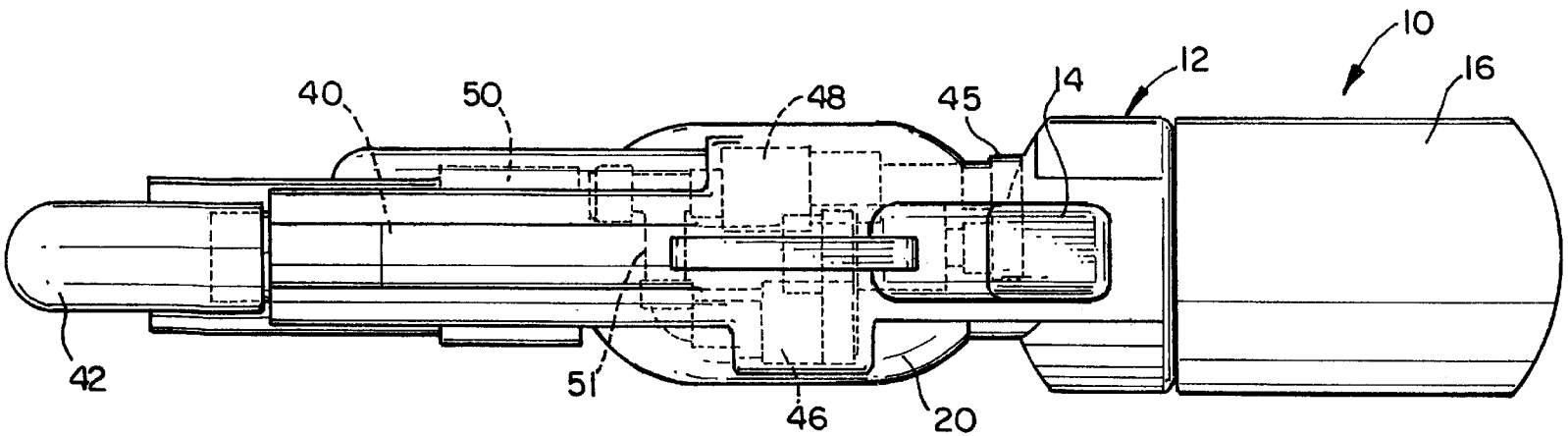
FIG. 4 is a bottom view of the toy water gun in accordance with the first embodiment of the present invention, in which the valving elements are shown in dashed lines.
Figure 3:
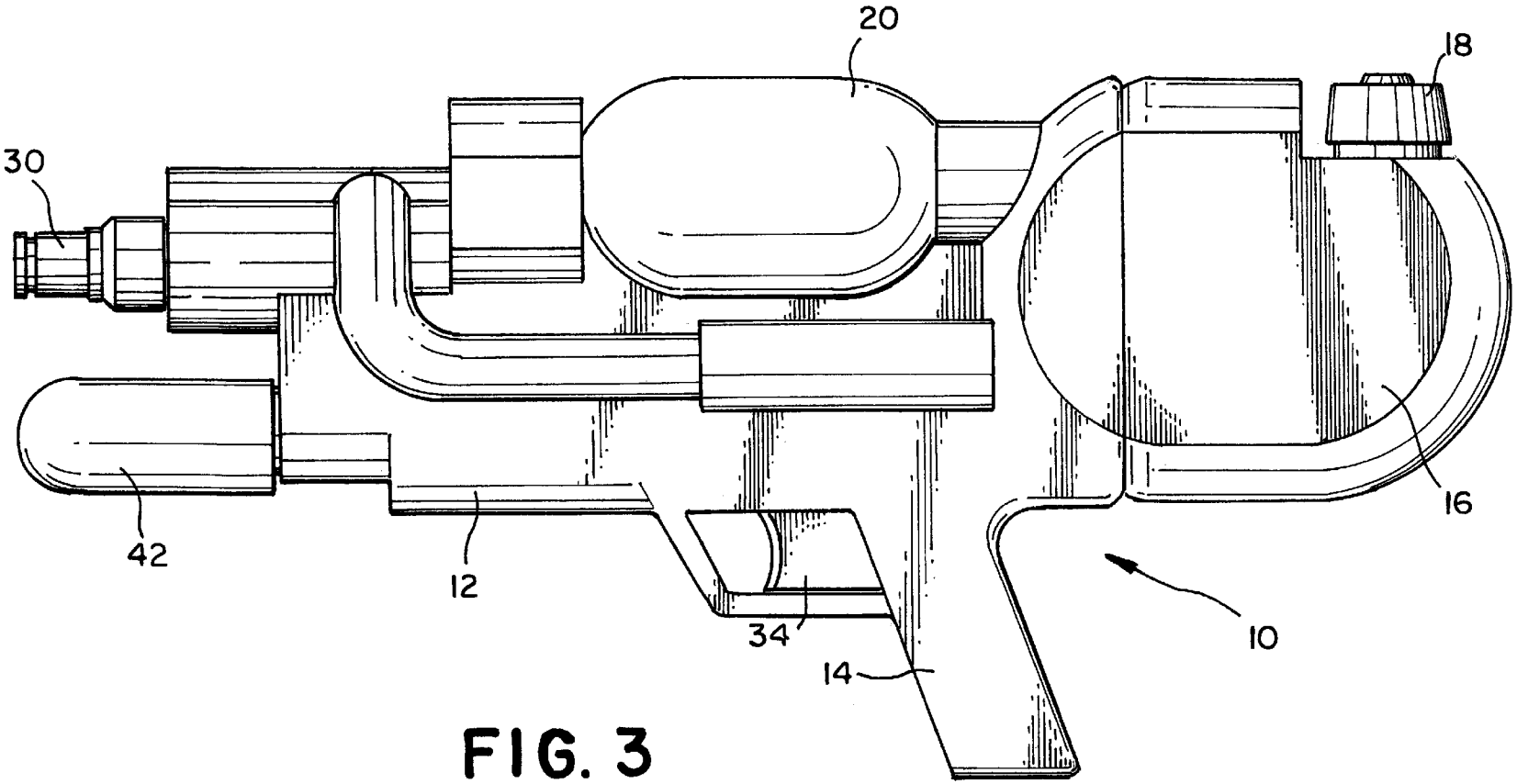
FIG. 3 is a right side elevational view of the toy water gun in accordance with the first embodiment of the present invention.
Figure 5:
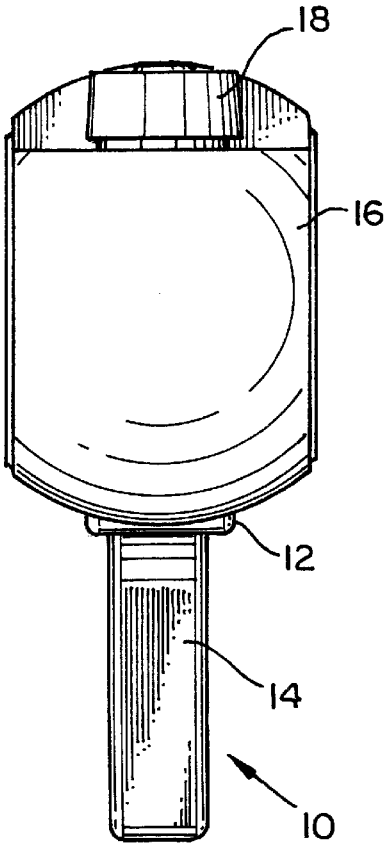
FIG. 5 is a rear elevational view of the toy water gun.
Figure 6:
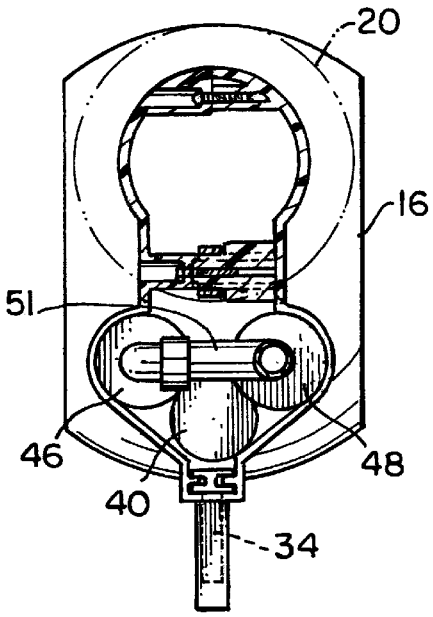
FIG. 6 is a cross-sectional view taken along lines 6—6 in FIG. 1.
Figure 7:
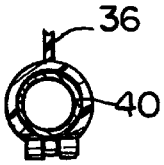
FIG. 7 is a cross-sectional view taken along lines 7—7 in FIG. 1.
Figure 8:
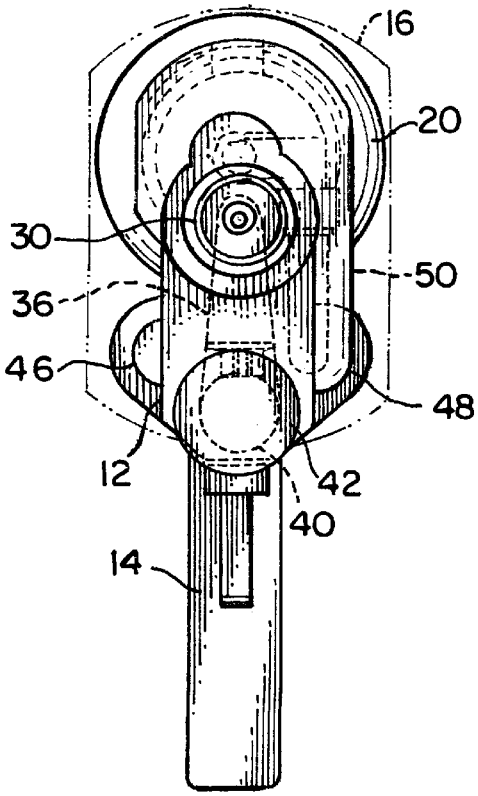
FIG. 8 is a front elevational view of the water gun in accordance with the first embodiment of the present invention.

As shown in detail in FIG. 1, a release valve 28 is located in the housing 12 at the front of the water gun 10 and is connected to the expandable bladder 52 located in the pressure chamber 20 via a path of fluid communication which includes a first pipe 24. The first pipe 24 has a first end and a second end. The first pipe 24 can be made by any desired method and be made from any material in any manner as long as the material has the ability to deliver liquid from one end to the other. The release valve 28 is similar to the valve disclosed in U.S. patent application Ser. No. 08/672,941, filed Jun. 28, 1996 now U.S. Pat. No. 5,799,827, which is incorporated herein by reference as if fully set forth. A stem 32 extends from the release valve 28 for opening the valve release 28 to discharge water or any other desired liquid from a nozzle assembly 30 which is located at the front of the housing 12 and in communication with the release valve 28. The release valve 28 is actuated via a trigger 34 which is attached to the housing 12 adjacent to the handle 14. The trigger 34 is biased to a first position via a spring 35 and is connected by a arm 37 to a sliding connection 36 which is connected to the stem 32. As shown in FIG. 6, the sliding connector 36 rides on the outside tube of a pump 40. Movement of the trigger 34 causes the valve stem 32 to be retracted, opening the release valve 28 and thereby regulating a discharge from the expandable bladder 52 which is ejected from the gun 10 as a stream of liquid from said nozzle assembly. However, it will be recognized by those skilled in the art from the present disclosure that other types of release valves 28 may be used, such as a pinched tube valve, and that the present invention is not limited to the specific valve 28 disclosed.

The path of fluid communication provides fluid communication between the expandable bladder 52, the nozzle assembly 30 and the pump 40. The path of fluid communication is a configuration of at least two pipes. Preferably, the first pipe 24, a second pipe 44, a cross pipe 51 as explained in more detail below.

The pump 40 is attached to the housing 12 and is in fluid communication with the liquid storage tank 16. The pump 40 includes a pump handle 42 which extends from the front of the water gun 10 such that it can be grasped by a user's hand to manually pump water from the liquid storage tank 16 through the path of fluid communication and into the expandable bladder 52 located in the pressure chamber 20 for charging the expandable bladder 52 such that the bladder 52 is expanded by liquid under pressure. The pump 40 could be any pump including portable pumps, piston or even a battery operated pump if desired and may be integral or separable. The pump 40 is connected to the storage tank via the second pipe 44, shown in FIG. 1, which is connected via a manifold 45, shown in FIGS. 1 and 4, to a pump valve assembly 46. The second pipe 44 includes a first end and a second end. The pump valve assembly 46 includes a first check valve 47 which allows water to be drawn from the storage tank 16, through the second pipe 44, into the manifold 45 and into a chamber 41 of the pump 40 as the handle 42 is moved in a forward direction away from the gun. As the handle 42 of the pump 40 is pressed inwardly toward the housing 12, the first check valve within the pump valve assembly 46 closes and a second check valve 49 opens allowing water to be discharged from the pump 40 through the cross pipe 51 to a third pipe 50 which is connected to the first pipe 24 at a junction 53 (shown in FIG. 1).

Both the third pipe 50 and the cross pipe 51 have first ends and second ends and can be made by any desired method from any suitable material in any manner as long as the pipes have the ability to deliver liquid from one end to the other.

With the valve 28 in the closed position, the water from the storage tank 16 is moved under pressure from the pump 40 into the bladder 52, which expands. The check valves within the valve assembly 46 prevent back flow of water from the expandable bladder 52 into the pump 40. When the trigger 34 is pulled and the valve 28 is opened, water is discharged through the first pipe 24 through the release valve 28 and the nozzle assembly 30. The second pipe 44 can be made by any desired method from any suitable material in any manner as long as the pipe has the ability to deliver liquid from one end to the other.

Referring again to FIGS. 1 and 4, a pressure release valve 48 is also connected to the path of fluid communication and is located between the manifold 45 and the third pipe 50 to prevent over pressurization of the bladder 52. The pressure release valve 48 allows for quick charging of the water gun 10 using an external source of pressurized water, such as pressurized tap water provided by a well pump or water pressure from public water mains, as explained in detail below.

Figure 11:
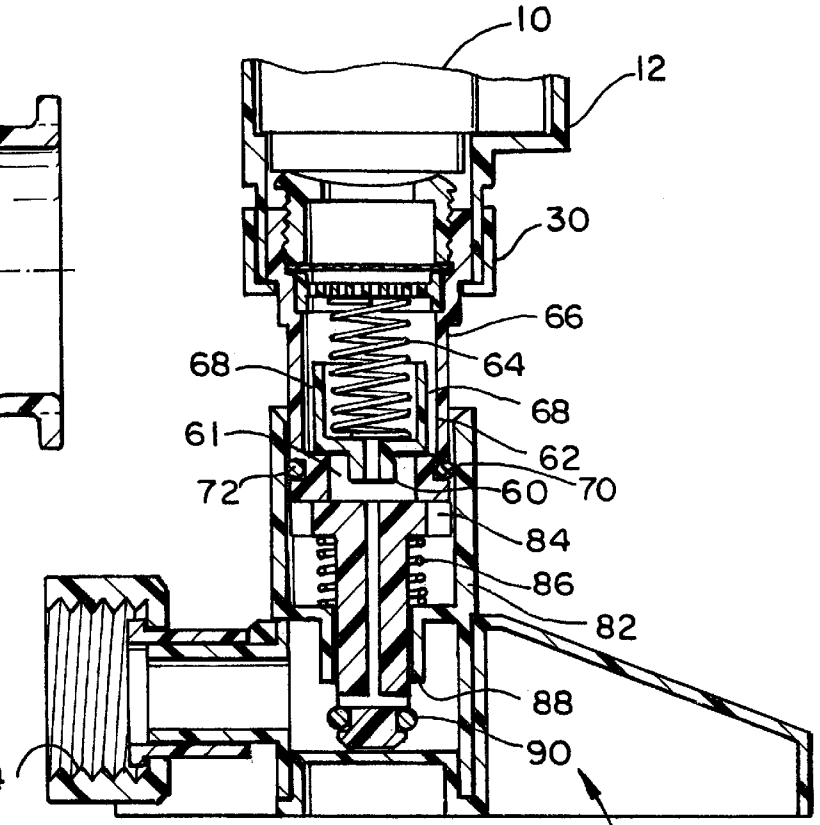
FIG. 11 is a cross-sectional view showing the nozzle of the toy water gun in accordance with the present invention being inserted in a hose adapter for charging the bladder and water tank.

Referring to FIG. 11, the nozzle assembly 30 which allows quick charging of the water gun 10 is shown in the charging position in a hose adapter or quick charge device 80. The nozzle assembly 30 includes a nozzle housing 66, a discharge opening 60 and a recharge opening 61 of a second size, which is larger than the discharge opening 60. A sliding nozzle member 62 is located in the nozzle housing 66, and the discharge opening 60 is located in the sliding member 62. The sliding nozzle member 62 is biased by a spring 64 to a forward most position within the nozzle housing 66. The sliding nozzle member 62 includes at least one channel 68 located around its periphery to allow for an increased flow area between the sliding nozzle member 62 and the wall of the housing 66 when the sliding member 62 is moved rearwardly in the nozzle housing 66 to form the recharge opening. The outside of the nozzle housing 66 includes a groove 70 for an O-ring seal 72 at the forward end. However, it will be recognized by those skilled in the art from the present disclosure that different types of valve assemblies can be utilized, and that the sliding member 62 can be omitted, if desired.

The hose adapter 80 includes a receptacle 82 for receiving the nozzle assembly 30 of the water gun 10. A valve body 84 which is held in a closed position via a spring 86 located in the receptacle 82. The valve body 84 is held by the spring 86 in a closed position against a seat 88 located on the hose adapter 80 and is sealed via an O-ring 90. A water channel 92 is located in the valve body 84 such that upon downward movement of the valve body 84, to the position shown in FIG. 11, water under pressure enters the water channel 92 and is conveyed through the valve body 84 to the nozzle assembly 30. A external hose attachment 94 is preferably provided on the hose adapter 80. However, it will be recognized by those skilled in the art from the present disclosure that other types of connectors can be provided for attaching the adapter 80 to a pressurized water source, such as public water. It will be similarly recognized that different types of valves and actuating mechanisms can be used, if desired. The hose adapter or quick charge device is preferably made from polymeric material in one or more pieces to be assembled. However, it is understood and recognized by those skilled in the art from the present disclosure that the hose adapter or quick charge device may be made using any desired method, and from any suitable material, as desired.

For quick charging of the water gun 10, the nozzle assembly 30 is inserted in the receptacle 82 of the hose adapter 80. Once the valve body 84 has been moved downwardly by the nozzle assembly 30, water under pressure flows through the channel 92 to the nozzle 30 and presses the sliding nozzle member 62 inwardly to allow a larger volume of water to flow through the recharge opening formed by the channels 68 located on the sliding nozzle member 62. The valve 28 can be opened via the water pressure acting on the closing surface of the valve 28 or mechanically upon insertion of the nozzle assembly 30 into the hose adapter 80 in order to allow a back flow of pressurized water through the valve 28 into the first pipe 24 of the path of fluid communication. Water initially flows into the bladder 52 as well as through the third pipe 50 to the pump valve assembly 46 on the pump 40 and the pressure release valve 48. After the bladder 52 expands with pressurized water to fill the inside of the pressure chamber 20, the pressure release valve 48 opens, allowing water to back fill through the manifold 45 and the second pipe 44 into the tank 16. Once the tank 16 is full, water is vented through the opening 19 in the cap 18 and the user withdraws the toy gun 10 from the hose adapter 80 with the bladder 52 fully charged and the tank 16 full for continued operation for recharging the bladder 52 via the pump 40. The pressure release valve 48 is set to an opening pressure which is slightly greater than the pressure required to charge the bladder 52.

Figure 10:
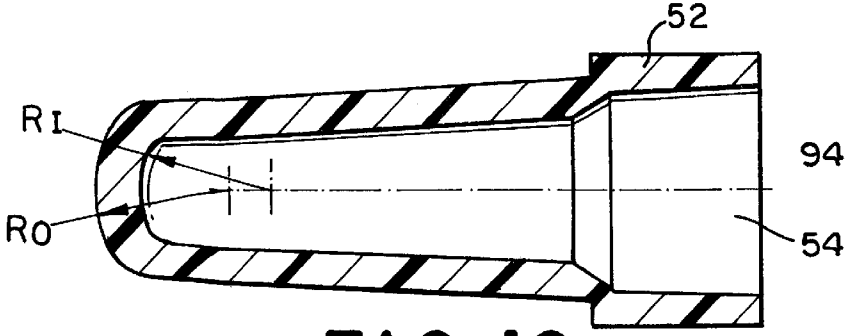
FIG. 10 is a cross-sectional view of a preferred embodiment of a bladder used with the toy water gun in accordance with the first embodiment of the present invention.

Referring now to FIG. 10, the bladder 52 is shown in detail. The bladder 52 is preferably molded from a natural rubber and is designed to have a tapered shape such that it can be molded using a simple two piece mold for ease of manufacturing. The bladder 52 includes a reduced cross-sectional area adjacent to the opening 54 to promote initial expansion in the area of the opening 54 prior to the reminder of the bladder 52 expanding to fill the reminder of the pressure chamber 20. It will be recognized by those skilled in the art from the present disclosure, that the bladder 52 may be made from other suitable materials, if desired, and that the shape can be varied to suit various pressure chamber dimensions. Significantly, by providing a bladder 52 which has a straight tapered profile, manufacturing costs can be reduced based on the use of a two piece mold such that the bladder 52 being easily released from the male and female mold parts.

Referring now to FIGS. 12–16, a second embodiment of a bladder water gun 110 in accordance with the present invention is shown. The water gun 110 in accordance with the second embodiment of the invention is similar to the water gun 10 in accordance with the first preferred embodiment of the invention, and like elements have been labeled with the same reference numerals with the prefix "1". For example, the pump 140 for the second embodiment of the water gun 110 is similar to the pump 40 for the first embodiment of the water gun 10. Accordingly, a detailed explanation of these similar items has been omitted for convenience only and the drawings have been labeled with the corresponding reference numerals for the sake of clarity. The differences between the second embodiment of the water gun 110 and the first embodiment 10 are described in detail below.

Figure 12:
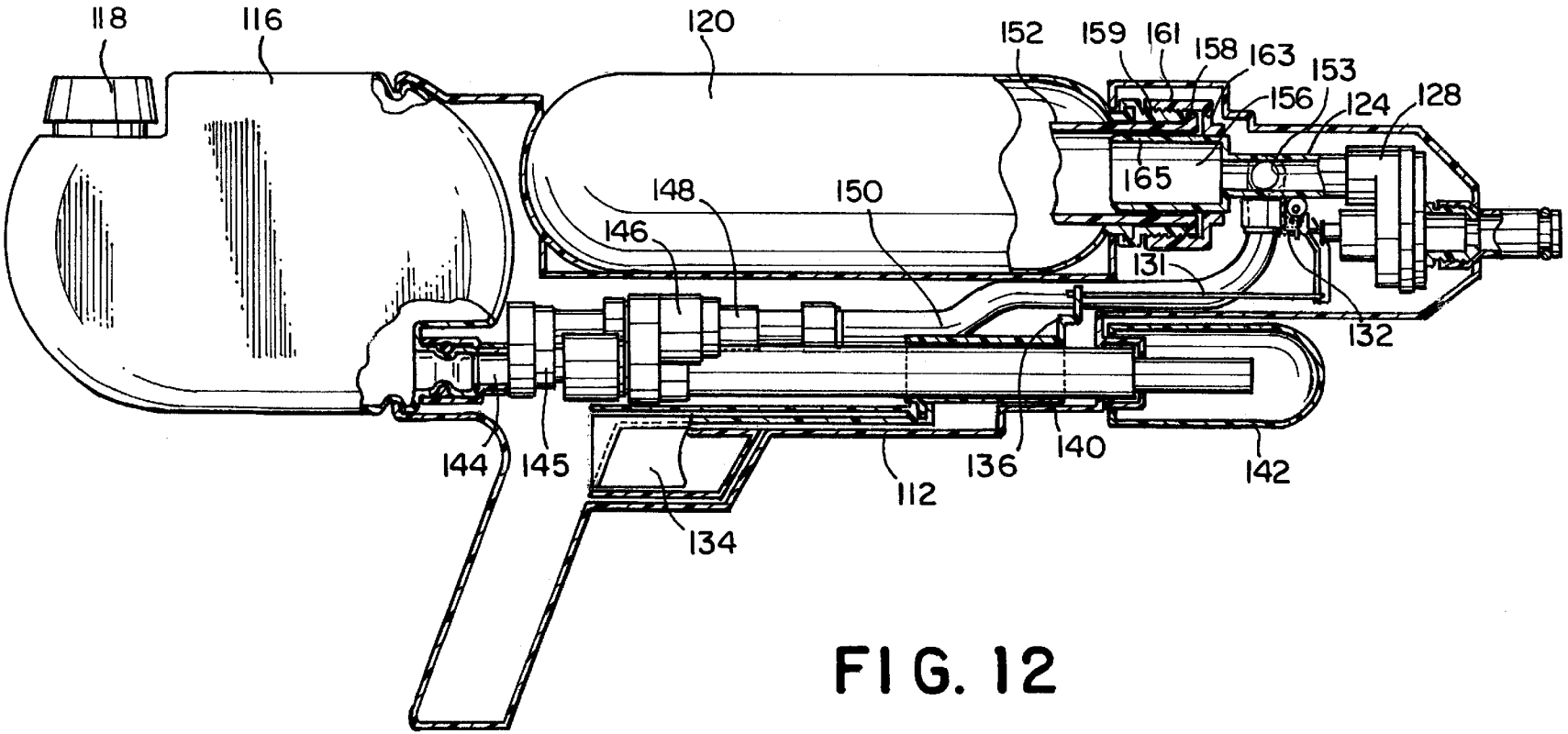
FIG. 12 is a side elevational view, partially broken away, showing a bladder water gun in accordance with a second embodiment of the present invention.
Figure 13:
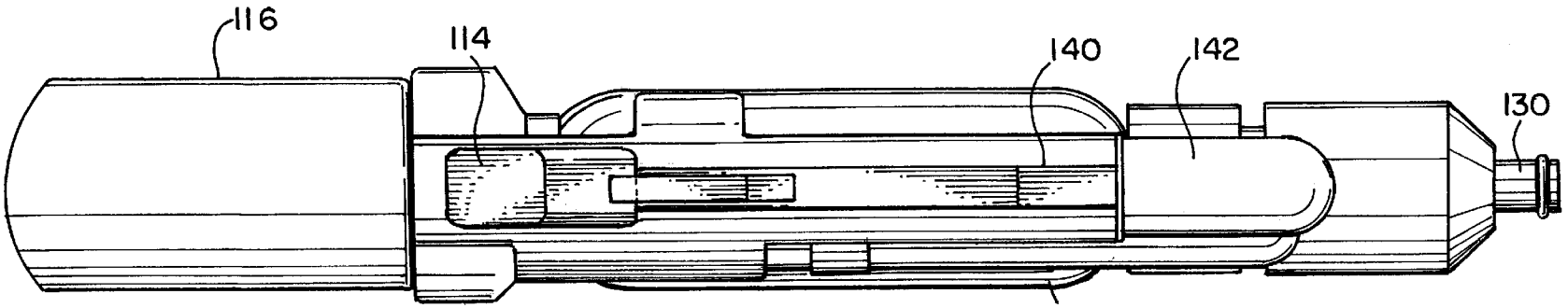
FIG. 13 is a bottom view of the water gun shown in FIG. 12.
Figure 14:
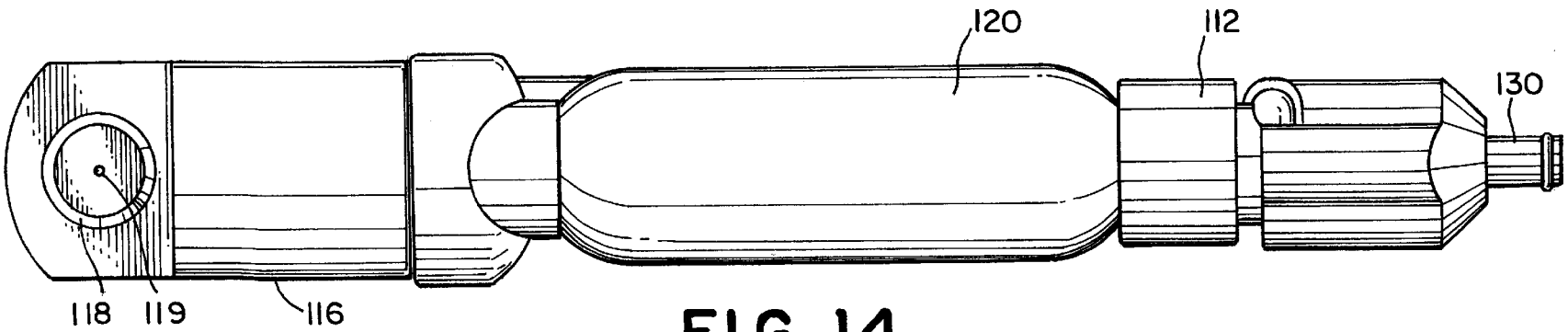
FIG. 14 is a top plan view of the toy water gun in accordance with the second embodiment of the present invention.
Figure 15:
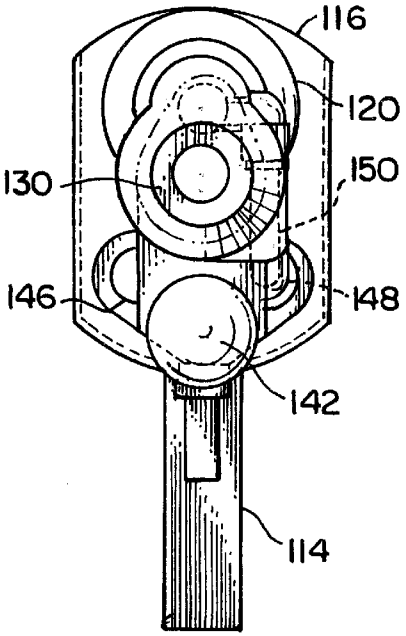
FIG. 15 is a front elevational view of the toy water gun in accordance with the second embodiment of the present invention.

As shown in FIG. 12, the water gun 110 includes an elongated pressure chamber 120 with a larger capacity bladder 152. Based on the increase in the size of the pressure chamber, the housing 112 is elongated. Accordingly, a linkage arm 131 is provided between the sliding connector 136 and the stem 132 of the release valve 128. The release valve 128 is preferably of the type described in Applicant's pending U.S. patent application Ser. No. 08/905,386, filed Aug. 4, 1997, which is incorporated herein by reference as if fully set forth. However, it will be recognized by those skilled in the art from the present disclosure that other types of valves may be used.

The tank 116 also has a larger capacity than the tank 16 in connection with the first preferred embodiment 10. However, it will be recognized by those skilled in the art from the present disclosure that any size tank may be provided.

Figure 16:
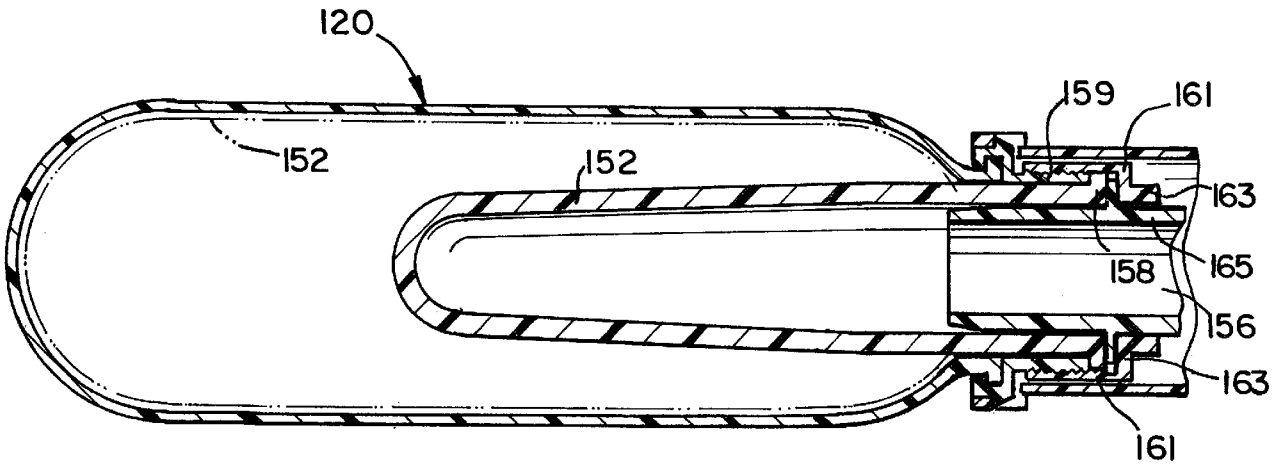
FIG. 16 is an enlarged partial cross-sectional view showing a second preferred embodiment of a bladder used in the second preferred embodiment of the water gun in accordance with the present invention.

Referring now to FIGS. 12 and 16, the bladder 152 is shown in detail. Preferably, the bladder 152 is made of a natural rubber material and has a conically tapered shape. This allows the bladder 152 to be made in a two piece mold that allows the male mandrel to be easily withdrawn from the bladder 152, and the bladder 152 can be easily removed from the female portion of the mold. The bladder 152 has an open end 156 with a flange 158 located around the opening. The flange 158 is used to secure the bladder 152 within the bladder housing 120. Threaded neck portions 159, which are preferably provided in two halves, are attached to the bladder housing 120 at the open end 156 and a threaded collar 161 having a radially inwardly extending flange 163 is used to clamp an insert 165 against the flange 158 of the bladder 152 and the neck portion 159. Preferably, the insert 165 has a connection 167 which allows for the connection of the first pipe 124. Using this type of bladder 152 provides for easier manufacturing and a secure attachment of the bladder 152 to the first pipe 124, as well as providing for secure location of the bladder 152 within the pressure chamber 120.

The water gun 110 is operated in the same manner as the water gun 10 and can be charged using the hose adapter 80. Due to the increased capacity of the bladder 152, the water gun 110 provides for a greater initial pressurized charge.

Figure 17:
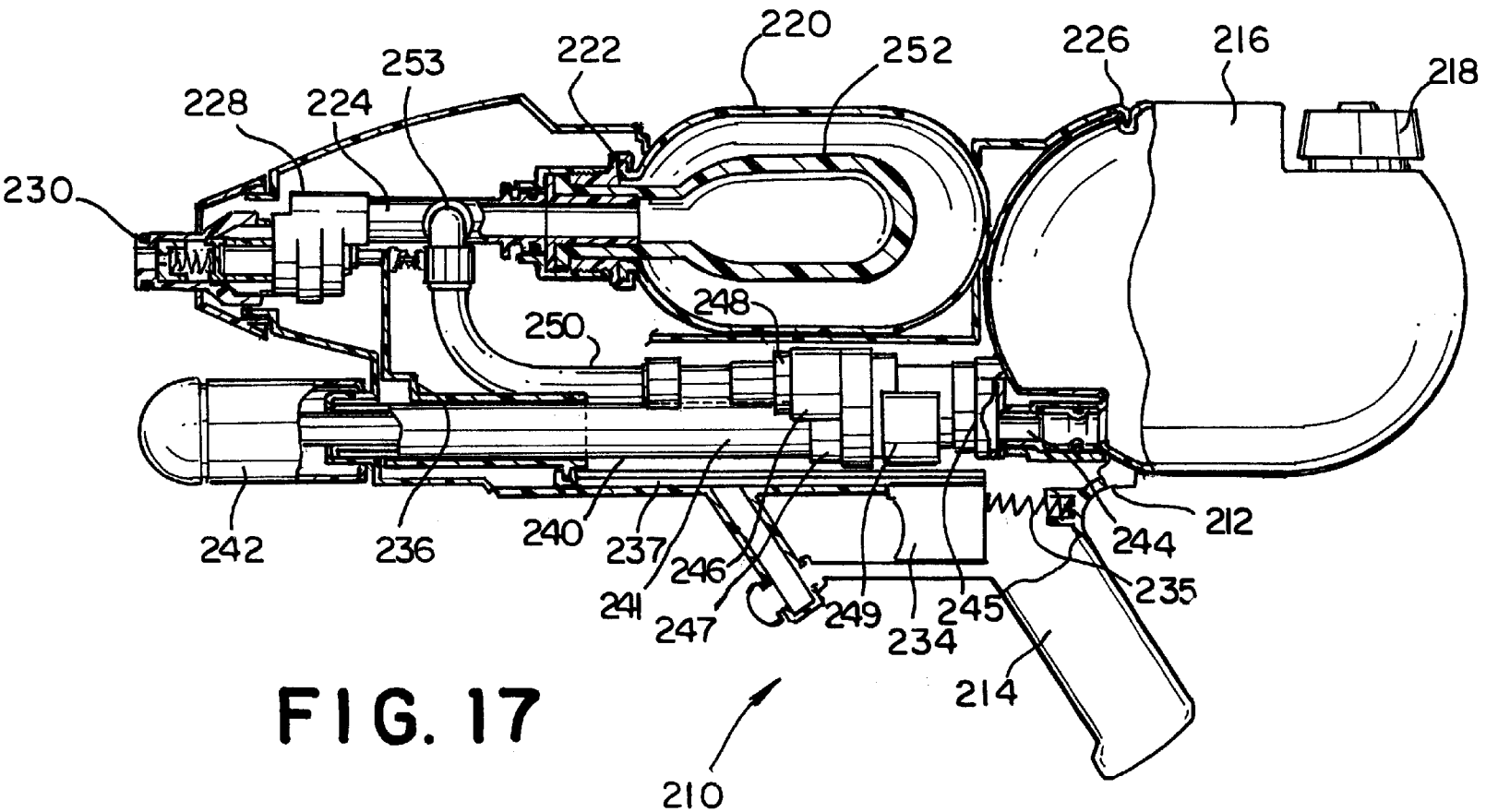
FIG. 17 is a side elevational view, partially broken away, showing a bladder water gun in accordance with a third embodiment of the present invention;.
Figure 18:
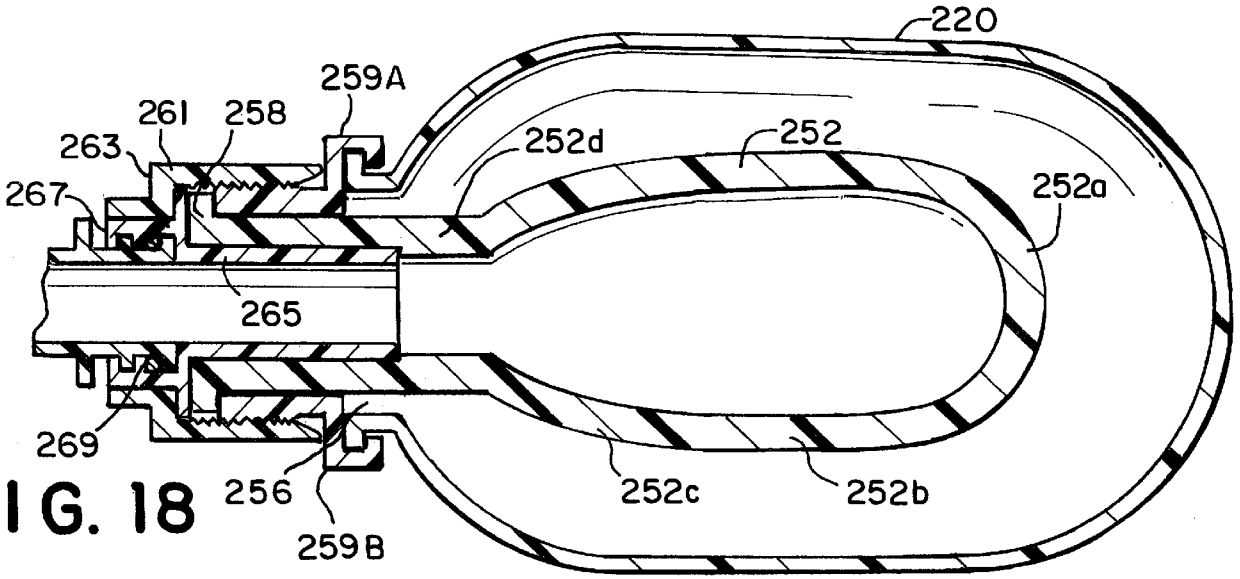
FIG. 18 is a greatly enlarged cross-sectional view of the bladder housing and bladder used with the water gun in accordance with the third embodiment of the invention shown in FIG. 17.

Referring now to FIGS. 17 and 18, a third embodiment of a bladder water gun 210 in accordance with the present invention is shown. The water gun 210 in accordance with the third embodiment of the invention is similar to the water gun 10 in accordance with the first preferred embodiment of the invention, and like elements have been labeled with the same reference numerals with the prefix "2". For example, the pump 240 for the third embodiment of the water gun 210 is similar to the pump 40 for the first embodiment of the water gun 10. Accordingly, a detailed explanation of these similar items has been omitted for convenience only and the drawings have been labeled with the corresponding reference numerals for the sake of clarity. The differences between the third embodiment of the water gun 210 and the first embodiment 10 are described in detail below.

As shown in FIG. 17, and in more detail in FIG. 18, the bladder 252 in the pressure chamber 220 has a different shape from the bladder 52 in order to enhance expansion and prolong the bladder life. As shown in FIG. 18, the bladder 252 has a hollow hemi-ellipsoidal closed end 252*a* which extends into a generally hollow cylindrical segment 252*b* which further transitions to a shape corresponding generally to a hollow frustum of an ellipsoid 252*c* which ends in a neck 252*d*. Overall, this forms a generally elongated tear drop-shaped bladder in order to promote radial expansion of the bladder 252 within the pressure chamber 220 until the expanding bladder contacts 252 contacts the inside walls of the pressure chamber 220, and then expands longitudinally until the bladder 252 is restricted from further expansion around its entire outer periphery by the pressure chamber 220.

The bladder 252 is clamped into the pressure chamber 220 and connected to the first pipe 224 via an insert 265, similar to the insert 165 of the second embodiment. Two threaded neck portions 259A, 259B, which are preferably provided as matching two halves, are attached to the bladder housing 220 at the open end 256 and a threaded collar 261 having a radially inwardly extending flange 263 is used to clamp the insert 265 against the flange 258 of the bladder 252 and the neck portions 259. Preferably, the insert 265 has a connection 267 which allows for the connection of the first pipe 224 using an O-ring 269 to seal the connection. However, it will be recognized by those skilled in the art from the present disclosure that any suitable clamping arrangement can be used to connect the first pipe 224 to the bladder 252 and to secure the bladder 252 in position within the pressure chamber 220.

Figure 20:
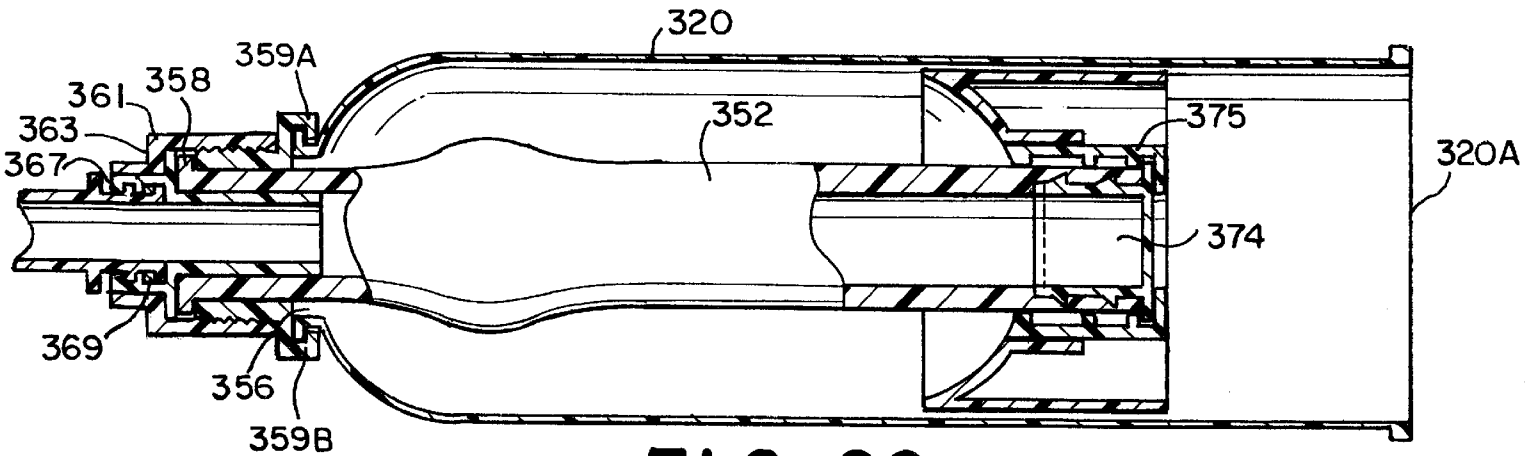
FIG. 20 is a greatly enlarged cross-sectional view of the bladder housing and bladder used with the water gun in accordance with the fourth embodiment of the invention shown in FIG. 19.
Figure 19:
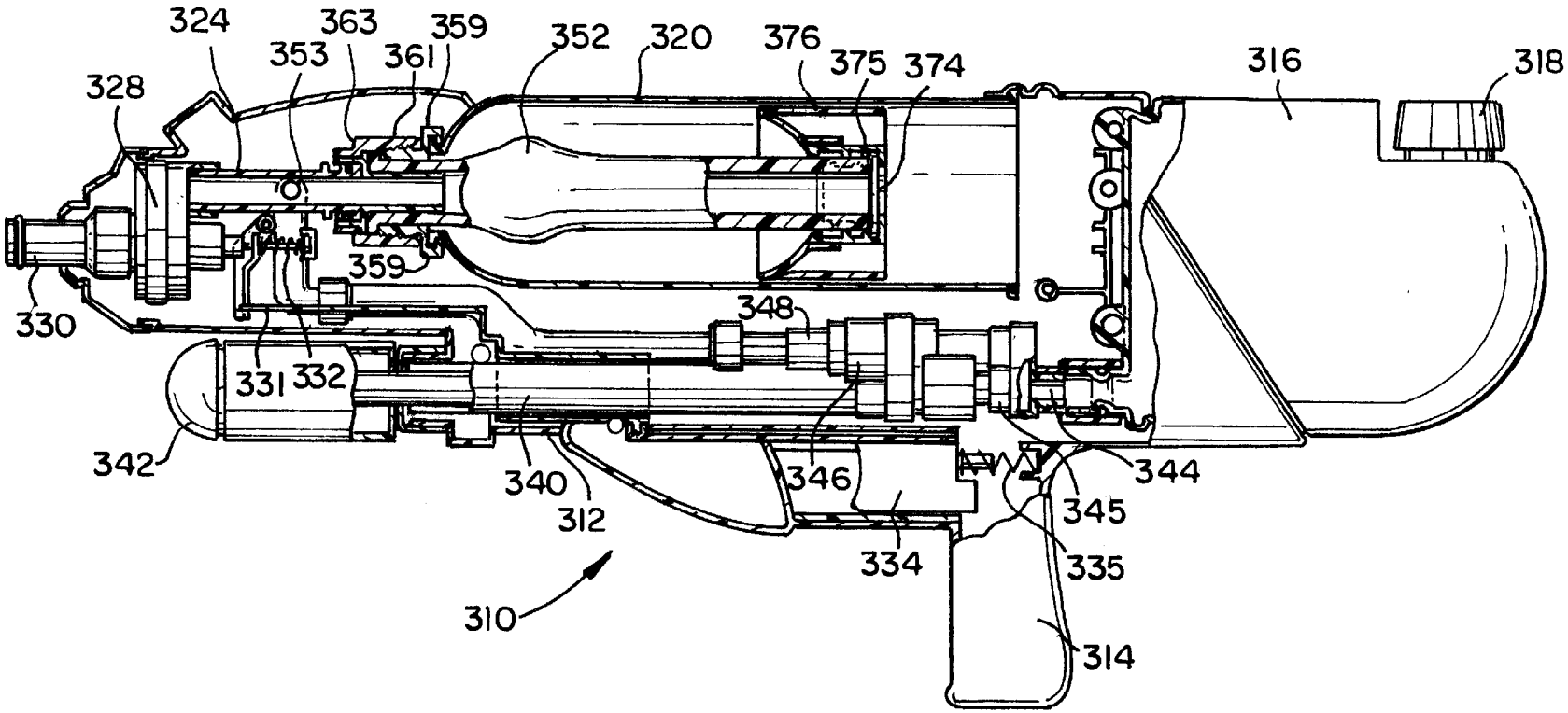
FIG. 19 is a side elevational view, partially broken away, showing a bladder water gun in accordance with a fourth embodiment of the present invention.

Referring now to FIGS. 19 and 20, a fourth embodiment of a bladder water gun 310 in accordance with the present invention is shown. The water gun 310 in accordance with the fourth embodiment of the invention is similar to the water gun 110 in accordance with the second preferred embodiment of the invention, and like elements have been labeled with the same reference numerals with the hundreds digit "3" in place of the hundreds digit "1". For example, the pump 340 for the fourth embodiment of the water gun 310 is similar to the pump 140 for the second embodiment of the water gun 110. Accordingly, a detailed explanation of these similar items has been omitted for convenience only and the drawings have been labeled with the corresponding reference numerals for the sake of clarity. The differences between the fourth embodiment of the water gun 310 and the second embodiment 110 are described in detail below.

As shown in FIG. 19, and in detail in FIG. 20, the bladder 352 is now in the form of an elongated tubular bladder 352 of the type disclosed in Applicant's prior U.S. Pat. Nos. 5,799,827 and 5,758,800, which are incorporated herein by reference as if fully set forth. The bladder 352 has an open first end and a plug 374 is provided in the second end which is held in position with clamps 375. A bladder carriage 376 is attached to the second end of the bladder 352 and has a complementary profile to the inside of the pressure chamber 320 such that it can slide along the inside of the pressure chamber 320 as the bladder 352 expands. The pressure chamber 320 includes an open end such that the carriage 376 can extend beyond the end of the pressure chamber 320 until it contacts ribs or stop bosses located in the housing 312 to limit further expansion of the bladder 352.

The first end of the bladder 352 is clamped to the pressure chamber 320 adjacent to the first end of the bladder 352 in a similar manner to that described above in connection with the third embodiment of the invention 210. The bladder 352 is connected to the first pipe 324 via an insert 365, similar to the insert 265 of the third embodiment. Two threaded neck portions 359A, 359B, are attached to the bladder housing 320 at the open end 356 and a threaded collar 361 having a radially inwardly extending flange 363 is used to clamp the insert 365 against the flange 358 of the bladder 352 and the neck portions 359A,B. Preferably, the insert 365 has a connection 367 which allows for the connection of the first pipe 324 using an O-ring 369 to seal the connection.

It will be appreciated by those skilled in the art that changes could be made to the embodiment described above without departing from the broad inventive concept thereof. It is understood, therefore, that the invention is not limited to the particular embodiment disclosed, and is intended to cover modifications within the scope and spirit of the present invention.

What is claimed is:

1. A toy gun for discharging a liquid under pressure, which comprises:

a housing;

a trigger attached to said housing;

a liquid storage tank connected to said housing;

a pressure chamber having an opening located on said housing;

an expandable bladder located in said pressure chamber;

a pump attached to said housing and in fluid communication with said liquid storage tank, said pump being adapted to transfer liquid from said liquid storage tank to said expandable bladder for charging said expandable bladder such that said bladder is expanded by liquid under pressure as said pump is actuated;

a release valve connected to said trigger for regulating a discharge of liquid from said expandable bladder;

a nozzle assembly in communication with said release valve, wherein said nozzle assembly includes a discharge opening of a first size and a recharge opening of a second size, which is larger than said first size;

a path of fluid communication connected between said expandable bladder, said pump, said liquid storage tank and said nozzle assembly, said nozzle assembly being adapted for insertion into a quick charge device which is adapted to force liquid from the quick charge device through the nozzle assembly and the path of fluid communication and into the expandable bladder to recharge the expandable bladder; and wherein movement of said trigger regulates movement of pressurized liquid through a part of said path of fluid communication for discharging a stream of liquid from said nozzle assembly.

2. The toy gun as claimed in claim 1, wherein said pump includes a pump handle adapted for manual actuation by a user.

3. The toy gun as claimed in claim 1, wherein said nozzle assembly further comprises a nozzle housing and a sliding nozzle member slidably disposed in said nozzle housing, the sliding nozzle member including said discharge opening and at least one channel formed between the sliding nozzle member and said nozzle housing.

4. The toy gun as claimed in claim 1, wherein said release valve is in fluid communication with said nozzle assembly and said path of fluid communication.

5. The toy gun as claimed in claim 1, wherein said path of fluid communication comprises at least two interconnected pipes.

6. The toy gun as claimed in claim 5, wherein a first pipe of said path of fluid communication has a first end and a second end, the first end is attached to said release valve and the second end is attached to said expandable bladder.

7. The toy gun as claimed in claim 6, wherein a second pipe of said path of fluid communication has a first end and a second end, the first end of said second pipe is attached to said storage tank and the second end of said second pipe is attached to said pump.

8. A toy gun as claimed in claim 6, wherein a cross pipe is included in said path of fluid communication.

9. The toy gun as claimed in claim 8, wherein a third pipe of said path of fluid communication has a first end and a second end, the first end of said third pipe is attached to said first pipe and the second end of said third pipe is attached to said cross pipe, said pump also being in fluid communication with said cross pipe.

10. The toy gun as claimed in claim 1, wherein a pressure release valve is connected to said path of fluid communication.

11. The toy gun as claimed in claim 10, wherein a vent opening is provided in said storage tank such that after said expandable bladder expands to fill said pressure chamber, said pressure release valve opens to allow liquid to fill said storage tank, when said storage tank is full, excess liquid is released through said vent opening.

12. The toy gun as claimed in claim 1, wherein said pump includes a pump valve assembly and is configured such that said pump handle extends from a front of said gun and can be grasped by a user to manually pump liquid from said storage tank.

13. The toy gun as claimed in claim 12, wherein said pump valve assembly comprises a first valve which allows liquid from said storage tank to be drawn through said second pipe into a chamber of said pump as said pump handle is moved in a direction away from said toy gun.

14. The toy gun as claimed in claim 13, wherein said pump valve assembly includes a second valve which is adapted to open when said pump handle is moved in a direction toward said toy gun, said second valve adapted to allow liquid in said chamber of said pump to be discharged from said chamber of said pump through said path of fluid communication into said expandable bladder.

15. A toy gun as claimed in claim 1, wherein said bladder contains an opening and a flange about said opening.

16. The toy gun as claimed in claim 1, wherein said expandable bladder is made of a natural rubber material and has a conically tapered shape.

17. A toy gun system adapted to discharge a stream of liquid under pressure, comprising:

a toy gun and a recharging adapter, the toy gun including:

a housing, a nozzle assembly at one end of said housing, wherein said nozzle assembly includes a discharge opening of a first size and a recharge opening of a second size, which is larger than said first size, a pump connected to the housing, a liquid storage tank attached to said housing, a pressurizable chamber having an opening located on said housing, an expandable bladder located in said pressure chamber, a path of fluid communication connected between said bladder, said pump, and said nozzle assembly, said recharging adapter having:

a receptacle to receive said nozzle assembly, a valve body slidably disposed in said receptacle, a liquid channel located in said valve body, an attachment on said recharging adapter for connection to an external source of pressurized liquid;

wherein when said nozzle assembly of said toy gun is inserted in said receptacle of said recharging adapter said valve body is displaced to an open position allowing liquid from an external source of pressurized liquid to travel through said valve body, said nozzle assembly and said path of fluid communication and into said expandable bladder.

18. The toy gun system as claimed in claim 17, wherein said nozzle assembly comprises a nozzle housing, a sliding nozzle member slidably disposed in said nozzle housing, a nozzle opening in the sliding nozzle member, and at least one channel between the sliding nozzle member and the nozzle housing.

19. The toy gun system as claimed in claim 18, wherein said nozzle opening has a size that is different than said at least one channel.

20. The toy gun system as claimed in claim 18, wherein said sliding nozzle member is movable from a first position in which said at least one channel is closed to a second position during recharging, in which said at least one channel is open, said sliding nozzle member being biased to the first position.

21. The toy gun system as claimed in claim 17, wherein a pressure release valve is provided in fluid communication between said storage tank and said path of fluid communication, and is adapted to open when said expandable bladder has expanded to fill said pressure chamber such that storage tank is filled.

22. The toy gun system as claimed in claim 17, wherein said path of fluid communication communicates with a valve assembly connected to said pump.

23. The toy gun system as claimed in claim 21, wherein said valve assembly includes at least two valves.

24. A method of operating a toy gun system comprising:

(a) providing a toy gun having a housing, a liquid storage tank attached to said housing, a pressure chamber having an opening located on said housing, an expandable bladder located in said pressure chamber, a pump, and a path of fluid communication between a nozzle assembly, said expandable bladder and said pump;

(b) providing a choice of charging said expandable bladder by one of:

(i) pumping liquid via said pump from said storage tank through said path of fluid communication into said expandable bladder; and (ii) inserting said nozzle assembly in a receptacle of a recharging adapter and thereby moving a normally closed valve body in said recharging adapter, to an open position allowing pressurized liquid to flow from said recharging adapter through said recharge opening in said nozzle assembly and said path of fluid communication into said expandable bladder;

(c) discharging said bladder by displacing said release valve via a trigger connected to said release valve to eject a stream of liquid from said toy gun; and (d) recharging said toy gun in accordance with step (b).

25. The method as claimed in claim 24, wherein said nozzle assembly includes a discharge opening of a first size and a recharge opening of a second size, which is larger than said first size.

26. The method as claimed in claim 25, wherein said nozzle assembly further comprises a nozzle housing and a sliding nozzle member slidably disposed in said nozzle housing, the sliding nozzle member including said discharge opening and at least one channel formed between the sliding nozzle member and said nozzle housing.

* * * * *